US005941006A

United States Patent [19]

Horton

[11] Patent Number: 5,941,006

[45] Date of Patent: Aug. 24, 1999

[54] TOP MOUNT FOR OFFSET TELESCOPIC SIGHT

[76] Inventor: John Wiley Horton, P.O. Drawer 840, Tallahassee, Fla. 32302

[21] Appl. No.: 09/039,508

[22] Filed: Mar. 16, 1998

[51] Int. Cl.[6] ..... F41G 1/38

[52] U.S. Cl. ..... 42/101

[58] Field of Search ..... 42/101; 33/245

[56] References Cited

U.S. PATENT DOCUMENTS

| | | | |
|---|---|---|---|
| 2,427,784 | 9/1947 | Herkner | 33/245 |
| 2,583,260 | 1/1952 | Felix | 33/245 |
| 2,803,907 | 8/1957 | Weaver | 33/245 |
| 3,986,285 | 10/1976 | Krisay | 42/101 |
| 4,383,371 | 5/1983 | Coffey | 33/245 |
| 5,425,191 | 6/1995 | Taylor et al. | 42/101 |
| 5,606,818 | 3/1997 | Hardee | 42/101 |

*Primary Examiner*—Charles T. Jordan
*Assistant Examiner*—Denise J Buckley

[57] ABSTRACT

A telescopic sight mount for the attachment of a telescopic sight in an offset position along one side of a rifle receiver, designed to allow the user an instant choice between the telescopic sight or the open sights. The mount has attachment features allowing it to use the standard scope mounting holes or dovetail fixtures found on the top of most bolt-action and automatic rifles. Scope cradles are formed integrally with the mount in order to increase rigidity and recoil resistance.

15 Claims, 8 Drawing Sheets

TOP MOUNT FOR OFFSET TELESCOPIC SIGHT

BACKGROUND

1. Field of Invention

This invention relates to telescopic rifle sights, and specifically to a mount which attaches to the top of a rifle and allows a telescopic sight to be offset to one side.

2. Description of Prior Art

It has long been known to attach a telescopic sight to a rifle so that the longitudinal axis of the telescopic sight is aligned with the bore of the rifle barrel. Various methods have been used, with the object generally being to place the telescopic sight directly above the rifle barrel. One result of this placement is that the traditional open sights are partially or completely obscured by the telescopic sight and its mounting hardware. While the loss of the open sights is typically not a problem, it is of great concern when the rifle is used on dangerous game. In game control and hunting situations, dangerous animals must often be shot from moderate ranges, necessitating the use of a telescopic sight. But, in those same situations, the user may be unexpectedly confronted by a charging animal at close range. In such an emergency, the telescopic sight is a great hindrance and the open sights are preferable. Thus, a system giving the user an instant choice between the telescopic sight or the open sights is very desirable.

Additionally, users typically must initially locate the target using the naked eye because thick brush and trees make using the telescopic sight impractical. The user must first locate the target with the naked eye, then raise the rifle and try to find the target within the telescopic sight. Because the telescopic sight has a narrow field of view, this operation is difficult. It is much easier to find the target using the open sights, because they do not restrict the user's field of view. Thus, a system allowing the user to locate the target with the open sights, and then transfer rapidly to the telescopic sight without moving the rifle is very desirable.

Several inventions have provided a clear optical path through the telescopic sight mounting hardware so that the open sights may still be used. Illustrating this technique are U.S. Pat. No. 4,299,044 to Johannsen (1981), and U.S. Pat. No. 4,688,345 to Kilgour (1987). Unfortunately, while the devices shown in '044 and '345 do allow the use of the open sights, the user's field of view is still largely obscured by the telescopic sight, and sighting a moving target is therefore very difficult.

Another approach well-known in the prior art is to offset the telescopic sight to one side. Illustrating this configuration are U.S. Pat. No. 2,449,551 to Garand (1948), U.S. Pat. No. 3,724,800 to Rubin (1973), and U.S. Pat. No. 3,986,285 to Krisay (1976). The devices shown in '800 and '285 are uniquely adopted to Winchester-type lever action rifles, sometimes called "cowboy rifles." They require the rifle to have a large planar vertical surface on one side of the receiver, making these inventions difficult to apply to other types of rifles. For example, there is no planar surface on a bolt-action rifle. Additionally, both inventions have separate base pieces and telescopic sight attachment rings, making the overall structure less rigid. While this loss of rigidity is not a huge concern for low-recoiling "cowboy rifles", it is a big concern for the heavier calibers addressed by the proposed invention. Another disadvantage shown in '800 and '285 is that both devices position the telescopic sight in a high position, thereby greatly obscuring the user's field of view when employing the open sights.

The '551 patent to Garand may reasonably be applied to a military automatic rifle, such as the U.S. Rifle Cal. 30, M1, for which it was designed. It could be more broadly applied to bolt action rifles. Unfortunately, the mounting system shown in '551 requires the drilling of a large hole through the side of the receiver and barrel, the placement of a dowel pin therein, and the machining of a slot on the opposite side of the receiver. For use on a bolt-action rifle, the device would require the removal of a large piece of the stock to gain access to the receiver side. These operations are well beyond the capabilities of most rifle owners, and would result in the partial disfigurement of the rifle. The '551 device also uses a separate base piece and telescopic sight attachment assembly, resulting in the same loss of rigidity mentioned previously. Finally, like the '285 and '800 patents, the '551 device mounts the telescopic sight in a high position, causing the same field of view obstruction explained previously.

The known methods for mounting an offset telescopic sight are therefore limited in that they: (1) Have separate base pieces and telescopic sight attachment assemblies, resulting in a loss of rigidity; (2) Are uniquely adopted to a specific type of rifle; (3) Mount to the side of the receiver, which in many instances would require the removal of a portion of the stock and disfigurement of the rifle; and (4) Mount the telescopic sight relatively high, which greatly obscures the user's field of view when employing the open sights.

OBJECTS AND ADVANTAGES

Accordingly, several objects and advantages of the present invention are:

(1) to mount a telescopic sight off to one side of the rifle receiver, thereby giving the shooter an instant choice to use either the telescopic sight or the open sights;

(2) to mount said telescopic sight very low alongside the rifle barrel and receiver, thereby giving the user the maximum unobstructed field of view for the open sights;

(3) to mount said telescopic sight in a position which allows the user to locate the target with the open sights, then transfer to the telescopic sight without moving the rifle;

(4) to provide an integral base piece and telescopic sight attachment, thereby increasing rigidity;

(5) to attach the mount to the rifle using the standard factory-drilled mounting holes for the attachment of telescopic sights, or, alternatively, to attach the mount to the rifle using the integral dovetail attach points found on some rifles;

(6) to attach the mount to the top of the rifle receiver;

(7) to eliminate any attachment to the side of the rifle receiver; and (8) to provide an extremely rigid system of clamping the telescopic sight mount to the rifle receiver, thereby enabling the system to withstand very heavy recoil.

These objects and advantages will be fully explained in the details hereafter described, explained, and claimed, with reference being made to the accompanying drawings.

DRAWING FIGURES

Reference Numerals in Drawings

| | | | |
|---|---|---|---|
| 10 | mount | 12 | mount attachment screw |
| 14 | scope clamp | 16 | telescopic sight |
| 18 | rifle | 20 | rifle receiver |
| 22 | threaded mounting hole | 24 | rear open sight |
| 26 | front open sight | 28 | dovetail attachment fixture |
| 30 | dovetail mount | 32 | dovetail clamp |
| 34 | dovetail attachment screw | 36 | integral scope clamp |
| 38 | smooth mounting hole | 40 | threaded clamp hole |
| 42 | smooth clamp hole | 44 | scope cradle |
| 46 | scope clamp screws | 48 | mounting rail |
| 50 | female dovetail slot | 52 | threaded dovetail hole |
| 54 | cross slot | 56 | smooth dovetail hole |
| 58 | top surface | 60 | left side surface |
| 62 | right side surface | 64 | rifle barrel |
| 66 | ejection port | 68 | operating bolt |
| 70 | threaded portion | 72 | screw head |
| 74 | lower surface | 76 | cylindrical journal |
| 78 | common axis | | |

DESCRIPTION—FIGS. 1 to 8

Figure 1:
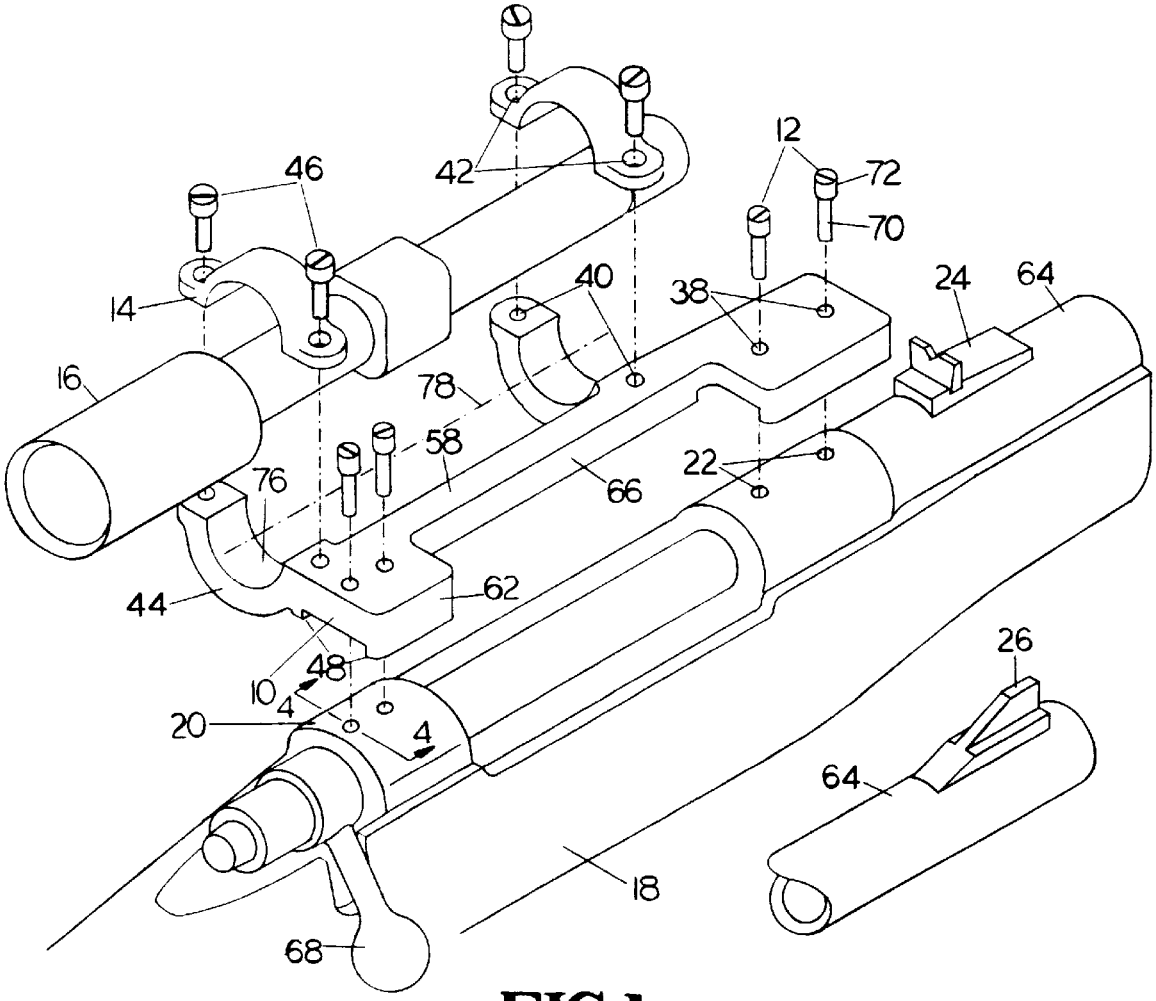
FIG. 1 is an exploded isometric view, showing how the proposed invention holds a telescopic sight and how it attaches to the top of a rifle.
Figure 2:
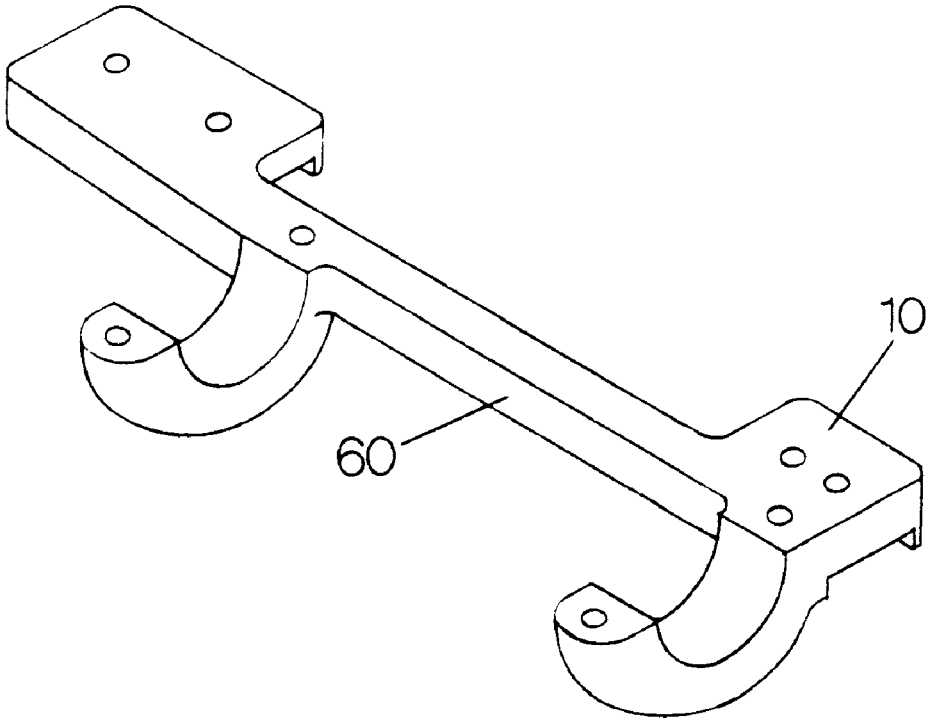
FIG. 2 is an isometric view, showing another side of the mount.

A typical embodiment of the present invention is illustrated in FIG. 1. Mount 10 is essentially formed in the shape of an elongated bar having top surface 58, right side surface 62, and left side surface 60 (shown in FIG. 2). Formed integrally with mount 10 are two scope cradles 44, each of which has a cylindrical journal 76, adopted to accept telescopic sight 16. Ejection port 66 is cut into mount 10 to facilitate the ejection of spent shell casings.

Figure 4:
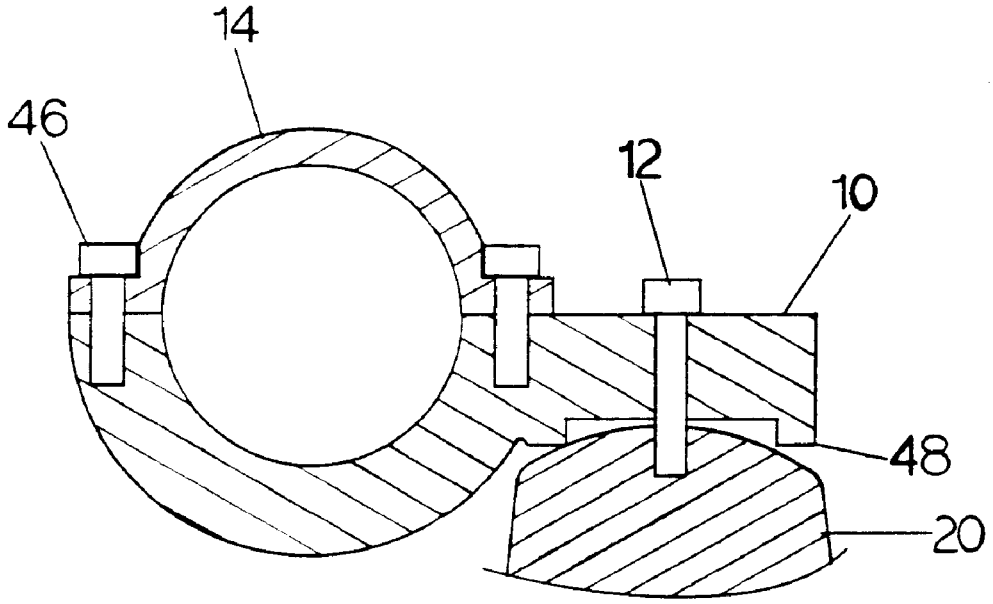
FIG. 4 is a cross-sectional view of the mount and rifle, showing the attaching screws in the preferred embodiment.

Also formed integrally with mount 10 are four mounting rails 48, which protrude downward from mount 10. Mounting rails 48 are shaped to bear against the top of rifle receiver 20 along very small contact areas, thereby concentrating the contact forces between mount 10 and rifle receiver 20. FIG. 4 shows a sectional view of mounting rails 48 in contact with rifle receiver 20.

Returning to FIG. 1, the assembly of the device will be easily comprehended. Mount 10 is attached to the top of rifle 18 by passing several mount attachment screws 12 through smooth mounting holes 38 and into threaded mounting holes 22 in rifle receiver 20. Smooth mounting holes 38 are large enough to allow threaded portion 70 of mount attachment screw 12 to pass through, but small enough to prevent the passage of screw head 72 of mount attachment screw 12. Mount attachment screws 12 pull mount 10 tightly against rifle receiver 20 as they are tightened. The cylindrical central portion of telescopic sight 16 is then placed in cylindrical journals 76 of scope cradles 44, which are integral features of mount 10. The two cylindrical journals 76 of scope cradles 44 lie along common axis 78, in order to ensure a fixed alignment of telescopic sight 16 with mount 10. Telescopic sight 16 may be moved forward and backward along common axis 78 in order to obtain an optimum placement for an individual shooter. When the desired location is set, scope clamps 14 are attached to scope cradles 44 of mount 10 by passing several scope clamp screws 46 through smooth clamp holes 42 and into threaded scope holes 40. Scope clamp screws 46 pull scope clamps 14 against the top of telescopic sight 16, thereby firmly clamping telescopic sight 16 into scope cradles 44 of mount 10. It may be readily appreciated that mount 10 places telescopic sight 16 close alongside rifle barrel 64.

Figure 3:
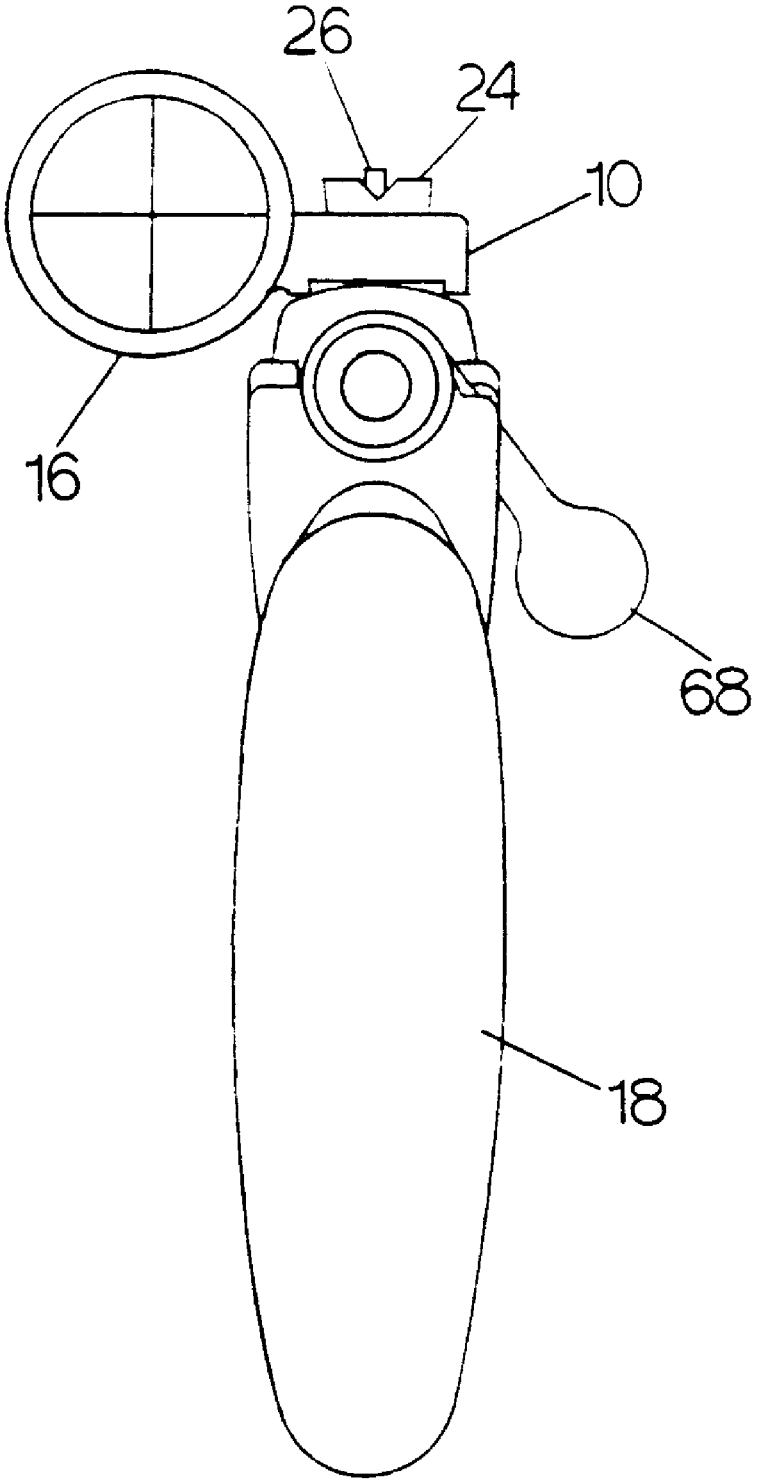
FIG. 3 is a rear elevation view, showing the mount and telescopic sight attached to a rifle.

FIG. 3 shows a rear view of rifle 18 with mount 10 and telescopic sight 16 attached as described in the foregoing. As may be seen, telescopic sight 16 is positioned low alongside rifle 18. The user therefore has a clear field of view for the use of rear open sight 24 and front open sight 26 in sighting a target.

FIG. 4 shows a sectional view of mount 10 attached to rifle receiver 20. This view shows how mount attachment screws 12 pull mounting rails 48 along underside of mount 10 against the curved surface of rifle receiver 20. In this way, a very high contact force is achieved over a small area, thereby reducing the likelihood that mount 10 will shift its position while enduring heavy recoil forces.

Figure 5:
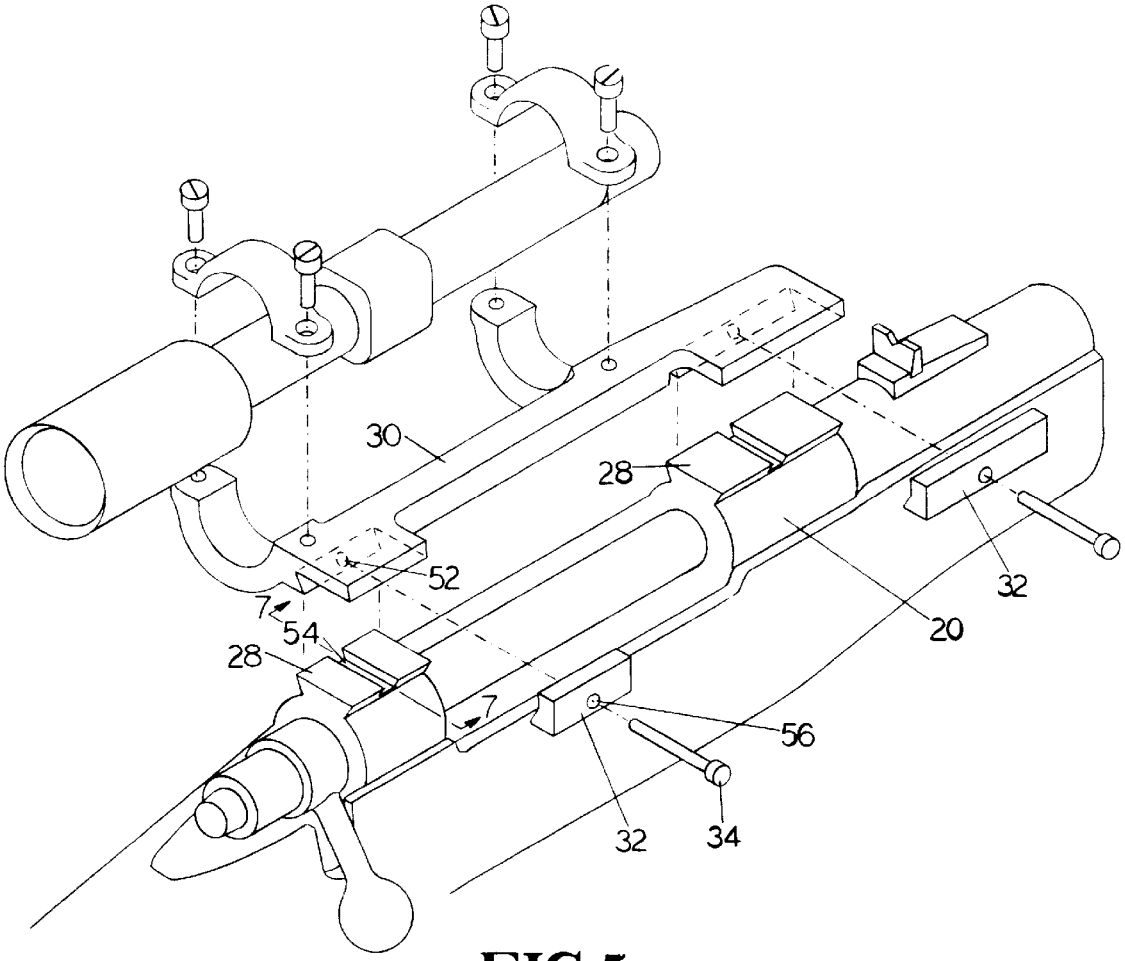
FIG. 5 is an exploded isometric view, showing how the proposed alternate embodiment of the mount holds a telescopic sight and how it attaches to the top of a rifle.
Figure 6:
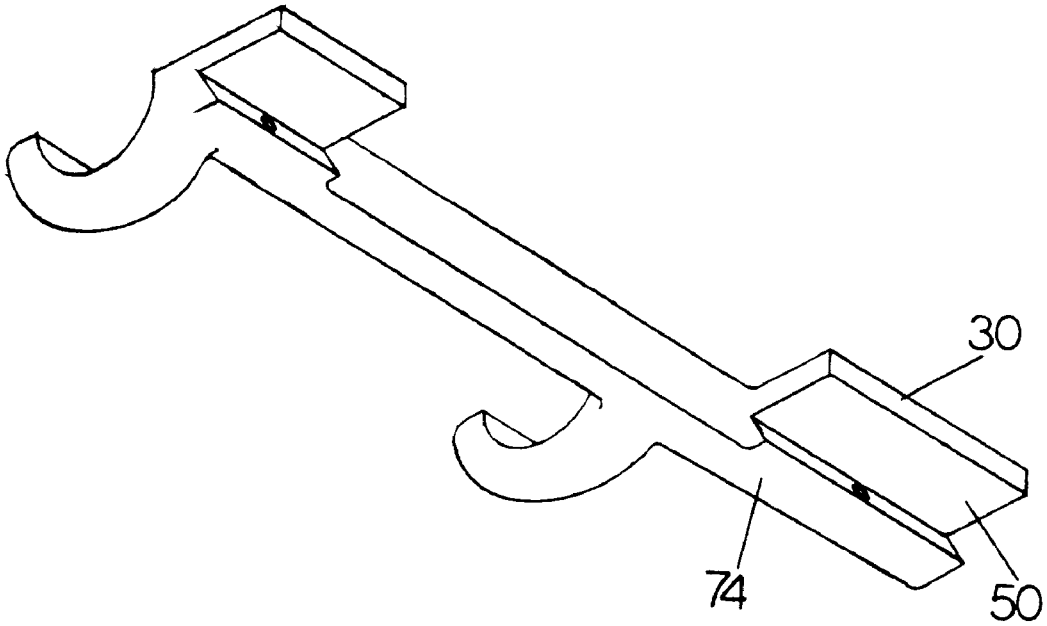
FIG. 6 is an isometric view, showing the underside of the proposed alternate embodiment of the mount.
Figure 7:
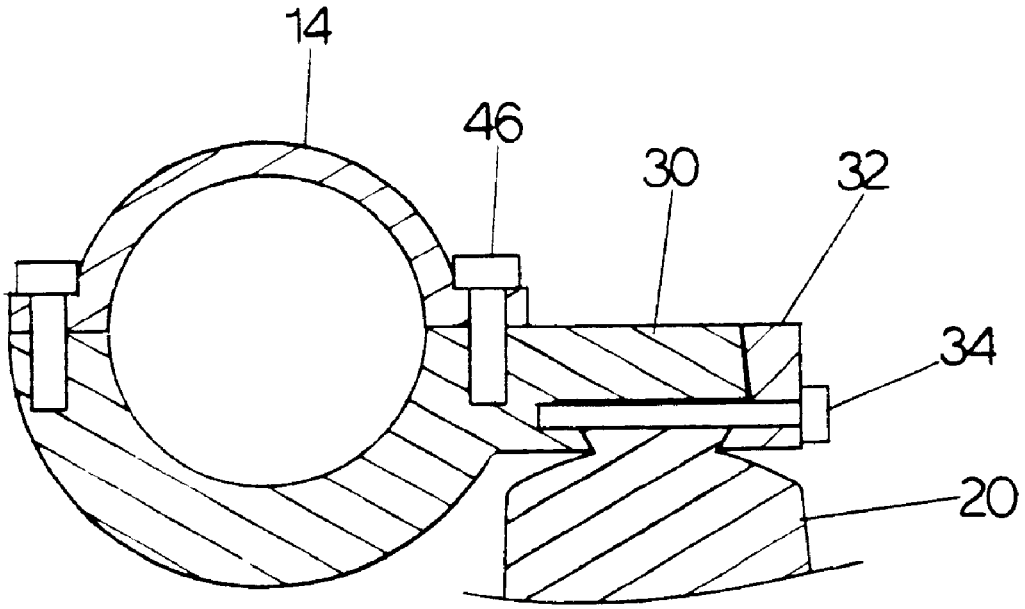
FIG. 7 is a cross-sectional view of the alternate embodiment of the mount, showing the attachment point between the mount and the dovetail attach points on the rifle.

FIG. 5 shows an alternate embodiment for use on rifles having integral dovetail attachment fixtures 28. Dovetail mount 30 is placed on top of dovetail attachment fixtures 28 on the top of rifle 18. Dovetail mount 30 has female dovetail slot 50 cut into lower surface 74, as shown in FIG. 6. Referring back to FIG. 5, dovetail mount 30 is placed atop rifle receiver 20 by placing female dovetail slot 50 onto dovetail attachment fixtures 28. Dovetail clamps 32 are then attached to dovetail mount 30 by passing dovetail screws 34 through smooth dovetail holes 56 in dovetail clamps 32, through cross slots 54, and into threaded dovetail holes 52, shown as hidden lines in FIG. 5. As dovetail screws 34 are tightened, dovetail clamps 32 are pulled tightly against dovetail attachment fixtures 28, thereby securing dovetail mount 30 to rifle receiver 20. FIG. 7 shows a sectional view of dovetail mount 30 attached to rifle receiver 20 by the clamping action of dovetail clamps 32 against dovetail attach fixtures 28.

Figure 8:
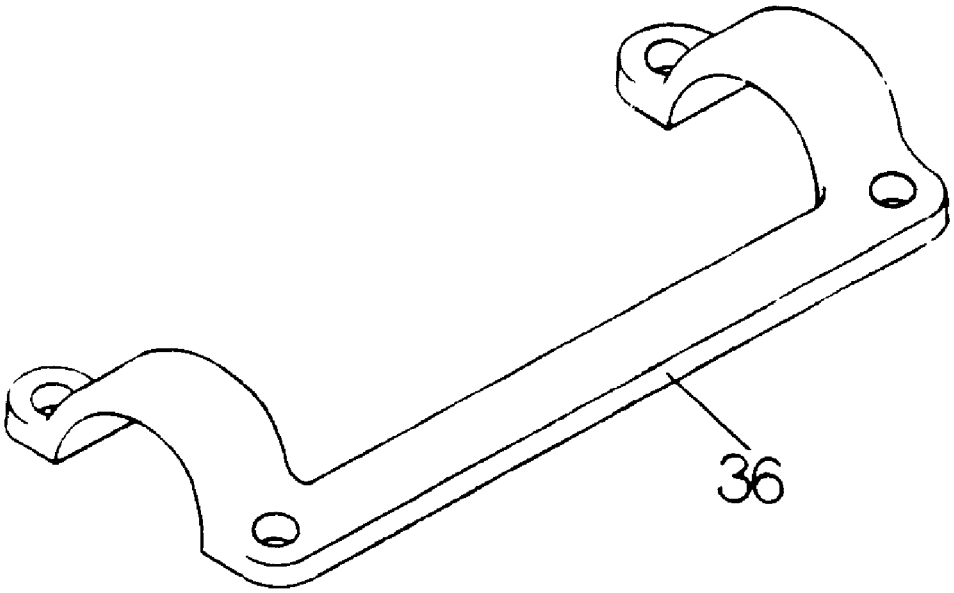
FIG. 8 is an isometric view, showing an alternate embodiment of the scope clamp.

FIG. 8 is an isometric view showing an alternate design for scope clamps 14. The two scope clamps 14 shown in FIG. 1 may be made as a single-piece integral scope clamp 36, as shown in FIG. 8. Integral scope clamp 36 adds extra rigidity to the assembly, making it even more recoil resistant. Integral scope clamp 36 may be used with any of the embodiments shown.

FIGS. 1 through 8 represent the preferred embodiments for a conventional rifle designed to be used by a right-handed user. In such a configuration, telescopic sight 16 is placed on the left side of rifle 18, as shown in FIG. 3. However, there are some rifles which are designed specifically for left-handed users. In these rifles, operating bolt 68 is placed on the left side of rifle 18, making it desirable to place telescopic sight 16 on the right side, so as to avoid interference with the function of operating bolt 68. To accomplish this placement, a mirror image of mount 10 is employed. All other hardware is identical. As this mirror image of mount 10 is simple to envision from the existing figures, it is not illustrated.

From the description above, a number of advantages of the proposed invention are apparent:

1. The mount places the telescopic sight very low alongside the rifle, thereby giving the user a wide field of view over the open sights.

2. The telescopic sight is still placed close enough to the rifle barrel to allow the user to hold the rifle in a normal fashion while using the telescopic sight.

3. The mount comprises an integral base piece and telescopic sight attachment features, thereby maximizing rigidity.

4. The mount may be attached to the rifle using existing mounting holes or dovetail features.

5. The mount attaches to the top of the rifle receiver and does not require the removal of any stock wood.

6. The mounting rails on the underside of the mount achieve a very high contact force with the rifle receiver, thereby ensuring that the mount will not shift its position under heavy recoil forces.

OPERATION—FIGS. 1 and 3

Mount 10 is attached to rifle receiver 20, and telescopic sight 16 is attached to mount 10, as described in the preceding. FIG. 3 shows the attached mount 10 and telescopic sight 16 affixed to rifle 18, from the view of the user about to aim and fire. By grasping rifle 18 conventionally, the user may elect to use telescopic sight 16 or the combination of rear open sight 24 and front open sight 26 by simply shifting his or her head a small amount to the left or right. Thus, the user is able to locate a target with the open sights, and then transfer rapidly to the telescopic sight. The user may also elect to use only the open sights.

SUMMARY, RAMIFICATIONS, AND SCOPE

Accordingly, the reader will appreciate that the proposed invention gives the user an instant choice of telescopic sight or open sights. By grasping the rifle in a conventional fashion, a small lateral shifting of the user's head allows switching back and forth between the two sighting methods. Furthermore, the proposed mount has additional advantages in that:

1. It mounts the telescopic sight very low alongside the receiver;
2. It allows the user to locate the target using the open sights and rapidly transfer to the telescopic sight;
3. It provides an integral base piece and telescopic sight attachment features, thereby increasing rigidity and recoil resistance;
4. It attaches to the rifle using the standard factory-drilled mounting holes for the attachment of telescopic sights, or, alternatively, attaches to the rifle using the integral dovetail attach points found on some rifles; and
5. It offsets the telescopic sight to the side of the rifle receiver, but attaches to the top of the rifle receiver.

Although the preceding description contains significant detailed information, it should not be construed as limiting the scope of the invention but as providing illustrations of some of the preferred embodiments of the invention. For example, many other methods could be used to attach the mount to the rifle receiver; the mount need not have planar surfaces; more than two scope cradles could be used, etc.

Thus, the scope of the invention should be fixed by the following claims, rather than by the examples given.

Having described my invention, I claim:

1. A device for attaching a telescopic sight to a rifle, comprising:

a. a mount, approximately in the shape of an elongated bar, lying along the top of a rifle receiver, with its long axis parallel to the rifle barrel, and having a top surface, a lower surface, a left side surface, and a right side surface, with said lower surface being adapted to attach directly to said top of said rifle receiver without the use of a separate base;

b. means for securing said mount to the top of said rifle; and c. at least one scope cradle, formed integral with said mount, protruding from said right side surface or said left side surface of said mount, and adapted to receive a telescopic sight.

2. A device as in claim 1, further comprising at least one scope clamp, adapted to clamp said telescopic sight into said scope cradle of said mount.

3. A device as in claim 1, further comprising at least two scope clamps, adapted to clamp said telescopic sight into said scope cradle of said mount.

4. A device as in claim 3, wherein the two scope clamps are formed as one integral piece.

5. A device as in claim 1 wherein said means for securing said mount to the top of said rifle comprises:

a. at least one mount attachment screw; and b. wherein said rifle receiver contains at least one threaded mounting hole sized to receive and engage said mount attachment screw.

6. A device as in claim 2 wherein said means for securing said mount to the top of said rifle comprises:

a. at least one mount attachment screw; and b. wherein said rifle receiver contains at least one threaded mounting hole sized to receive and engage said mount attachment screw.

7. A device as in claim 3 wherein said means for securing said mount to the top of said rifle comprises:

a. at least one mount attachment screw; and b. wherein said rifle receiver contains at least one threaded mounting hole sized to receive and engage said mount attachment screw.

8. A device as in claim 4 wherein said means for securing said mount to the top of said rifle comprises:

a. at least one mount attachment screw; and b. wherein said rifle receiver contains at least one threaded mounting hole sized to receive and engage said mount attachment screw.

9. A device as in claim 1 wherein said means for securing said mount to said top of said rifle comprises:

a. at least one dovetail attachment fixture integral to said top of said rifle receiver; and b. wherein said lower surface of said mount opens into at least one female dovetail slot sized to fit closely over said dovetail attachment fixture.

10. A device as in claim 2 wherein said means for securing said mount to said top of said rifle comprises:

a. at least one dovetail attachment fixture integral to said top of said rifle receiver; and b. wherein said lower surface of said mount opens into at least one female dovetail slot sized to fit closely over said dovetail attachment fixture.

11. A device as in claim 3 wherein said means for securing said mount to said top of said rifle comprises:

a. at least one dovetail attachment fixture integral to said top of said rifle receiver; and b. wherein said lower surface of said mount opens into at least one female dovetail slot sized to fit closely over said dovetail attachment fixture.

12. A device as in claim 4 wherein said means for securing said mount to said top of said rifle comprises:

a. at least one dovetail attachment fixture integral to said top of said rifle receiver; and b. wherein said lower surface of said mount opens into at least one female dovetail slot sized to fit closely over said dovetail attachment fixture.

13. A device for attaching a telescopic sight to a rifle, comprising:

a. a mount, approximately in the shape of an elongated bar, lying along the top of a rifle receiver, with its long axis parallel to the rifle barrel, and having a top surface, a lower surface, a left side surface, and a right side surface, with said lower surface being adapted to attach directly to said top of said rifle receiver without the use of a separate base;

b. means for securing said mount to the top of said rifle; and c. at least two scope cradles, formed integral with said mount, protruding from said right side surface or said left side surface of said mount, with each of said scope cradles having aligned cylindrical journals adapted to receive a telescopic sight.

14. A device as in claim 13, further comprising at least one scope clamp, adapted to clamp said telescopic sight into said scope cradle of said mount.

15. A device for attaching a telescopic sight to a rifle, comprising:

a. a mount, approximately in the shape of an elongated bar, lying along the top of a rifle receiver, with its long axis parallel to the rifle barrel, and having a top surface, a lower surface, a left side surface, and a right side surface;

b. at least two mounting rails, formed integrally with said lower surface of said mount, running along the same axis as said rifle barrel, and adapted to bear against the top of said rifle receiver;

c. means for securing said mount to the top of said rifle; and d. at least one scope cradle, formed integral with said mount, protruding from said right side surface or said left side surface of said mount, and adapted to receive a telescopic sight and place said telescopic sight low alongside said rifle receiver.

* * * * *